US006138716A

United States Patent [19]

Yen

[11] Patent Number: 6,138,716

[45] Date of Patent: Oct. 31, 2000

[54] SPOUT ASSEMBLY ADAPTED TO BE IN FLUID COMMUNICATION WITH A FAUCET

[75] Inventor: David Yen, Taichung, Taiwan

[73] Assignee: Globe Union Industrial Corporation, Taiwan

[21] Appl. No.: 09/401,284

[22] Filed: Sep. 23, 1999

[51] Int. Cl.[7] ..... E03C 1/02

[52] U.S. Cl. ..... 137/801; 4/678; 239/587.1

[58] Field of Search ..... 4/678; 137/801; 239/587.1; 285/302

[56] References Cited

U.S. PATENT DOCUMENTS

| | | | |
|---|---|---|---|
| 1,758,115 | 5/1930 | Kelly | 239/587.1 X |
| 2,100,186 | 11/1937 | Hagopian | 239/587.1 X |
| 2,776,168 | 1/1957 | Schweda | 239/587.1 X |

*Primary Examiner*—Gerald A. Michalsky
*Attorney, Agent, or Firm*—Foley & Lardner

[57] ABSTRACT

A spout assembly includes an inner tube adapted to be in fluid communication and in watertight connection with a faucet body, and an outer tube telescopically fitted on the inner tube. The outer tube includes a proximate tubular end slidably fitted on an outer circumferential wall of the inner tube, a distal tubular end extending beyond the inner tube, and an inner peripheral wall facing the outer circumferential wall. A lock member includes a latch portion disposed in the inner peripheral wall, a stem portion disposed diametrically opposite to the latch portion and radially and outwardly of the outer tube so as to permit an external operation of the stem portion, and a connecting portion disposed therebetween. Thus, the latch portion is movable between an arrested position, where the latch portion is registered with and extends into one of the retaining recesses of the outer circumferential wall so as to arrest the outer tube from moving relative to the inner tube, and a retracted position, where the latch portion is radially moved to be relieved from the retaining recess and to permit sliding movement of the outer tube relative to the inner tube. A biasing member is disposed to bias the latch portion to extend into one of the retaining recesses in the arrested position.

8 Claims, 5 Drawing Sheets

SPOUT ASSEMBLY ADAPTED TO BE IN FLUID COMMUNICATION WITH A FAUCET

BACKGROUND OF THE INVENTION

1. Field of the Invention

This invention relates to a spout assembly adapted to be in fluid communication with a faucet, more particularly to a spout assembly with telescopic inner and outer tubes and a lock member to retain the outer tube relative to the inner tube.

2. Description of the Related Art

Referring to FIG. 1, a conventional faucet is shown to be mounted on a kitchen sink 4 and includes a faucet body 1, a valve 2 to control the flow of water stream into the faucet body 1, and a spout 3 mounted on and movable relative to the faucet body 1 toward dish accommodating spaces 4*a*,4*b*. Since the length of the spout 3 is fixed, it is difficult for the flow of water stream from the spout 3 to reach the surrounding wall of the larger dish accommodating space 4*a*, thereby causing inconvenience to the user.

SUMMARY OF THE INVENTION

The object of the present invention is to provide a spout assembly which has telescopic outer and inner tubes adapted to be mounted on and in fluid communication with a faucet body and a lock member to retain the outer tube relative to the inner tube.

According to this invention, the spout assembly includes an inner tube and an outer tube telescopically fitted on the inner tube. The inner tube includes a first tubular end portion adapted to be in fluid communication and in watertight connection with a faucet body, a second tubular end portion opposite to the first tubular end portion in an axial direction, and an intermediate tubular portion interposed therebetween. The outer tube includes a proximate tubular end which is slidably fitted on an outer circumferential wall of the intermediate tubular portion and proximate to the first tubular end portion, a distal tubular end opposite to the proximate tubular end and extending beyond the second tubular end portion, and a middle tubular portion interposed between the proximate and distal tubular ends. The middle tubular portion has an inner peripheral wall facing the outer circumferential wall and including first and second segments respectively proximate and distal to the proximate tubular end. The outer circumferential wall of the intermediate tubular portion has a plurality of retaining recesses spaced apart from and aligned with one another in the axial direction. A lock member includes a latch portion disposed in the inner peripheral wall, a stem portion disposed diametrically opposite to the latch portion and radially and outwardly of the middle tubular portion so as to permit an external operation of the stem portion, and a connecting portion connecting the latch portion to the stem portion so as to permit the stem portion to move the latch portion radially between an arrested position, where the latch portion is registered with and extends into one of the retaining recesses so as to arrest the inner peripheral wall from moving relative to the outer circumferential wall, and a retracted position, where the latch portion is radially moved to be relieved from the retaining recess and to permit sliding movement of the inner peripheral wall relative to the outer circumferential wall. A biasing member is disposed to bias the latch portion to extend into the retaining recess in the arrested position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
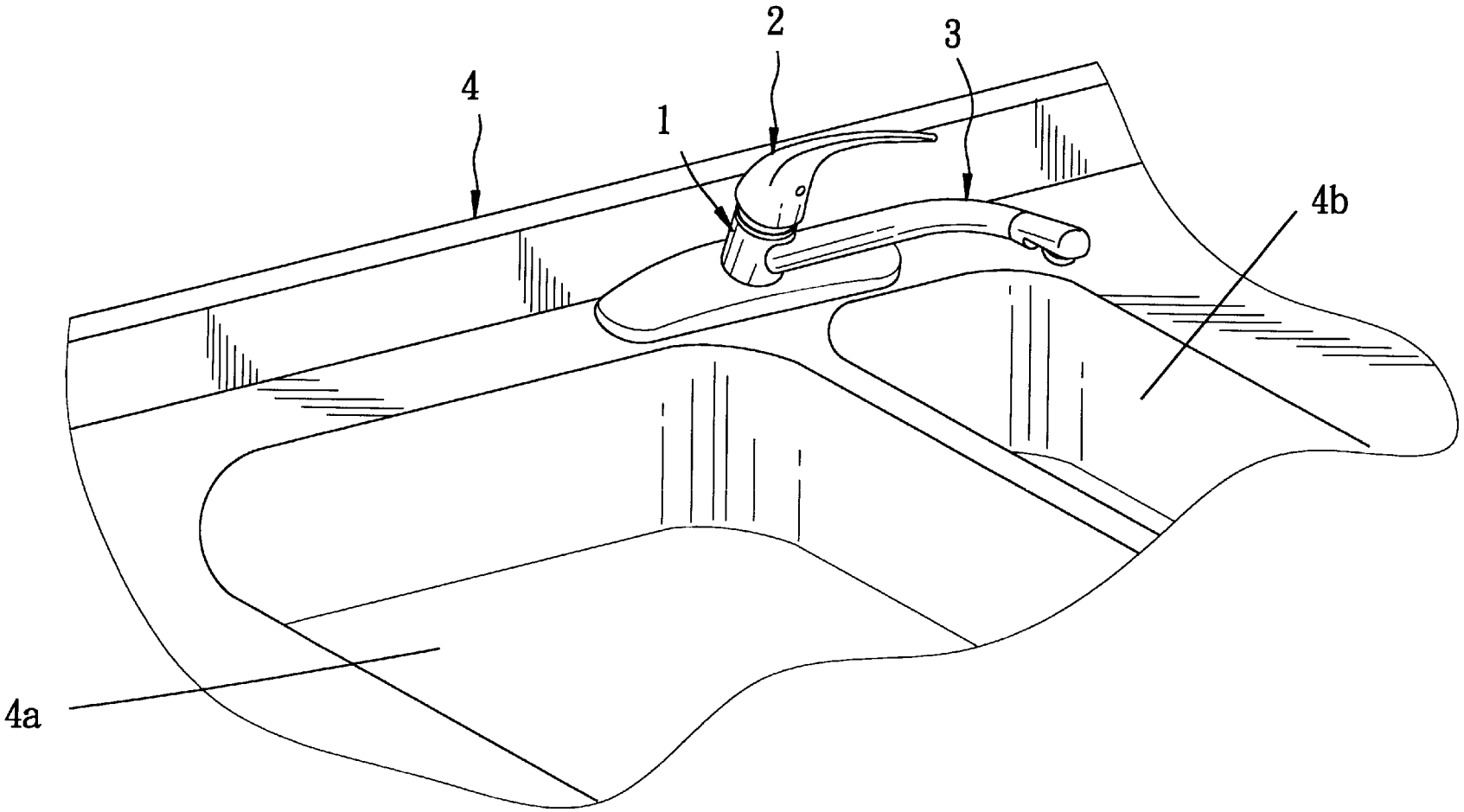
FIG. 1 PRIOR ART
FIG. 1 is a schematic perspective view of a conventional faucet on a kitchen sink.
Figure 2:
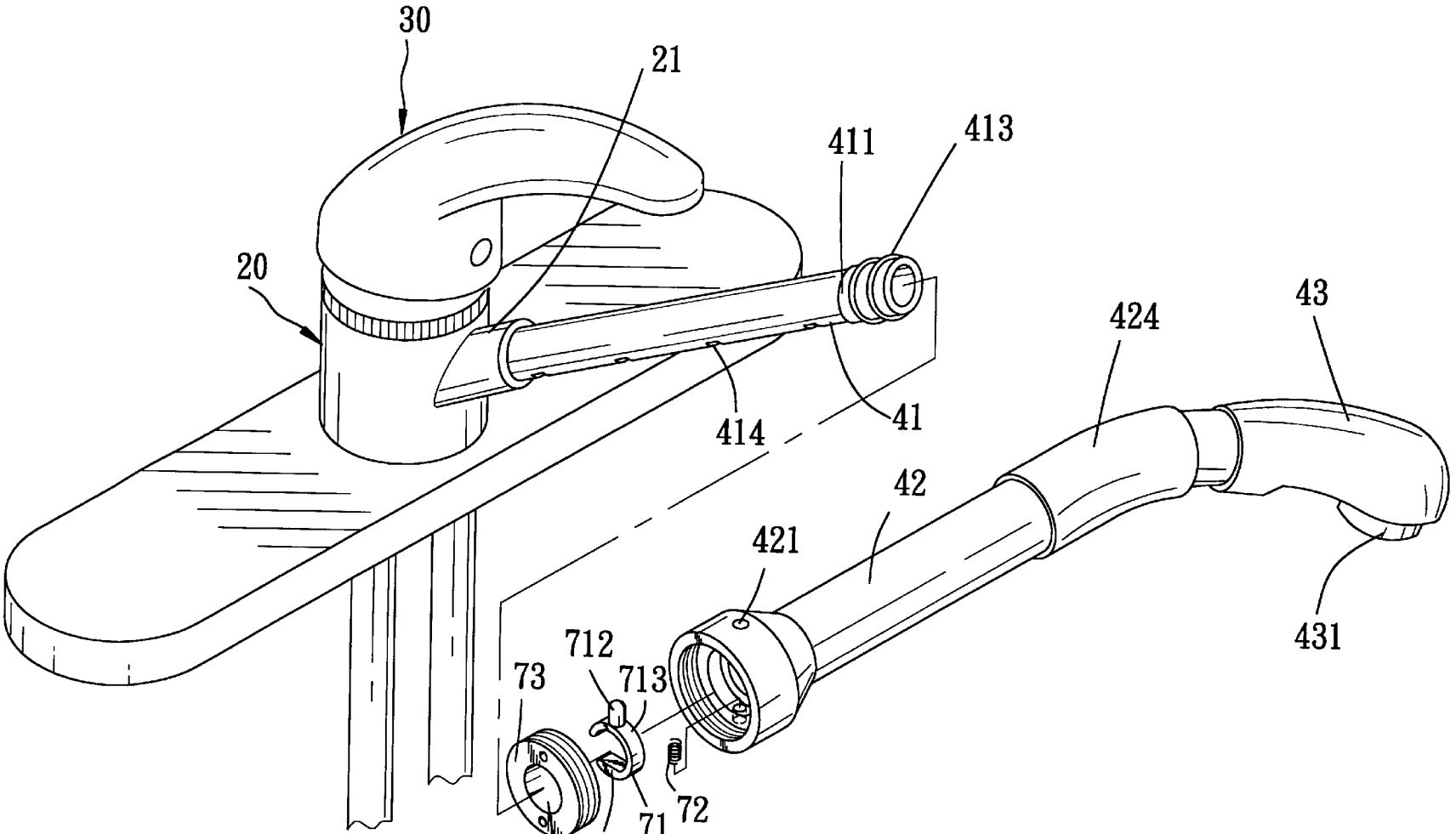
FIG. 2 is perspective view of a preferred embodiment of a spout assembly according to this invention when mounted on a faucet body.
Figure 3:
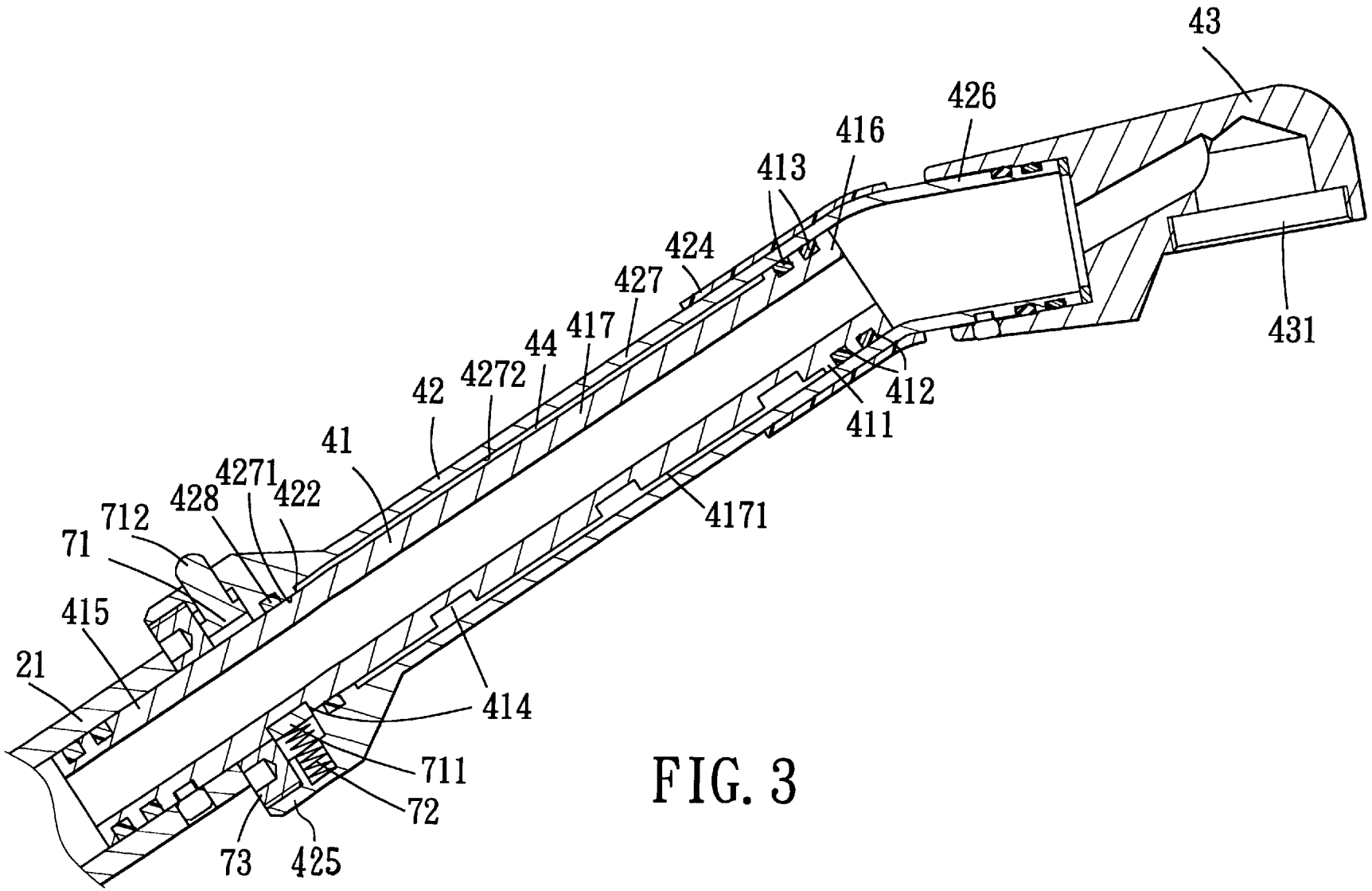
FIG. 3 is a sectional view of the preferred embodiment.

Referring to FIGS. 2 and 3, the preferred embodiment of the spout assembly according to the present invention is shown to be mounted on and in fluid communication with a faucet body 20 of a faucet. The faucet has a valve 30 to control the flow of water stream into the faucet body 20. The spout assembly includes an inner tube 41 and an outer tube 42 which is telescopically fitted on the inner tube 41.

The inner tube 41 includes a first tubular end portion 415 which is adapted to be in fluid communication and in water tight connection with an outlet tube 21 of the faucet body 20, a second tubular end portion 416 opposite to the first tubular end portion 415 in a first axial direction, and an intermediate tubular portion 417 which is interposed between the first and second tubular end portions 415,416, and which has an outer circumferential wall 4171. The outer circumferential wall 4171 has a plurality of retaining recesses 414 which are disposed therein, and which are spaced apart from and aligned with one another in the first axial direction. In addition, the second tubular end portion 416 has two annular grooves 412 for receiving two friction rings 413 therein for water tight contact with the outer tube 42.

The outer tube 42 includes a proximate tubular end 425 which is slidably fitted on the outer circumferential wall 4174 and which is proximate to the first tubular end portion 415, a distal tubular end 426 which is disposed opposite to the proximate tubular end 425 and which extends beyond the second tubular end portion 416, and a middle tubular portion 427 which is interposed between the proximate and distal tubular ends 425,426. The middle tubular portion 427 has an inner peripheral wall that faces the outer circumferential wall 4171 and that includes first and second segments 4271,4272 respectively proximate and distal to the proximate tubular end 425. The second segment 4272 is radially spaced from the outer circumferential wall 4171. In particular, the middle tubular portion 427 has an annular abutment shoulder 422 which is disposed radially at a juncture of the first and second segments 4271,4272. The outer circumferential wall 4171 has an annular barrier portion 411 which is disposed proximate to the second tubular end portion 416 so as to cooperate with the abutment shoulder 422 to confine an annular accommodating area 44 between the second segment 4272 and the outer circumferential wall 4171. Thus, the abutment shoulder 422 will be blocked by the barrier portion 411 from further movement during the sliding movement of the first segment 4271 relative to the outer circumferential wall 4171 so as to prevent the first segment 4271 from slipping over and falling out of the second tubular end portion 416.

An annular friction member 428 is disposed in the first segment 4271 and is in slidable contact with the outer circumferential wall 4171 so as to retard the sliding movement of the first segment 4271 relative to the outer circumferential wall 4171.

A lock member 71 includes a latch portion 711 which is disposed in the inner peripheral wall of the outer tube 42 proximate to the proximate tubular end 425, a stem portion 712 which is disposed diametrically opposite to the latch portion 711 and radially and outwardly of a through hole 421 in the middle tubular portion 427 so as to permit an external operation of the stem portion 712, and a connecting portion 713 which connects the latch portion 711 to the stem portion 712. The connecting portion 713 is arcuate in shape, and is disposed around and is spaced apart from the intermediate tubular portion 417. A fastening member 73 is mounted on the proximate tubular end 425 to retain the lock member 71 in the inner peripheral wall of the outer tube 42. The fastening member 73 has an axial hole 731 for passage of the inner tube 41.

A biasing member 72, such as a compression spring, is disposed between the latch portion 711 and the first segment 4271 in a second axial direction radial to the first axial direction.

A spout head 43 is mounted on the distal tubular end 426 of the outer tube 42, and has an outlet 431 for changing directions of the water stream.

In addition, a scald-preventing member 424 can be disposed to wrap around the middle tubular portion 427 proximate to the distal tubular end 426 to serve as a handgrip.

Figure 4:
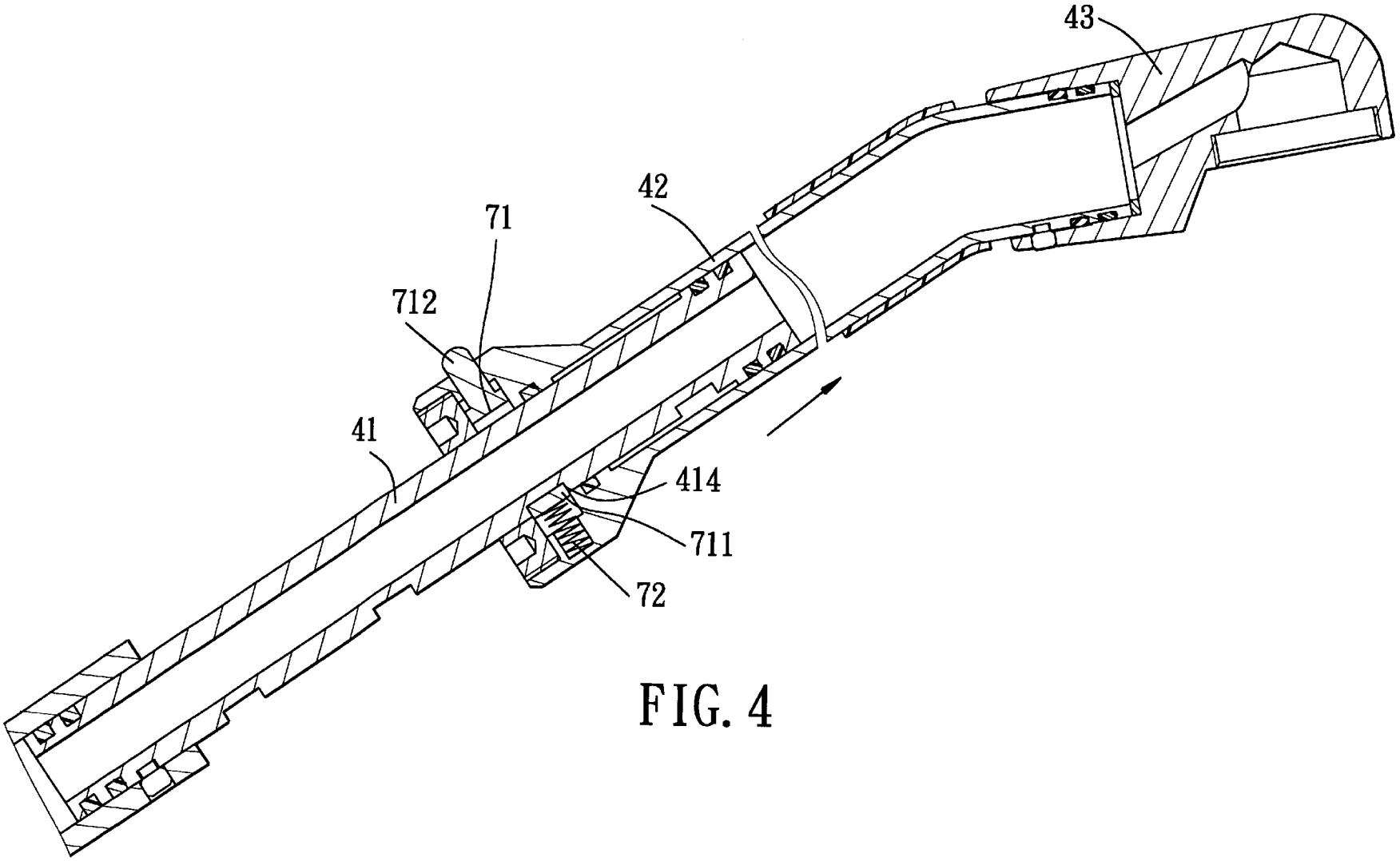
FIG. 4 is a sectional view of the preferred embodiment in an extended state.
Figure 5:
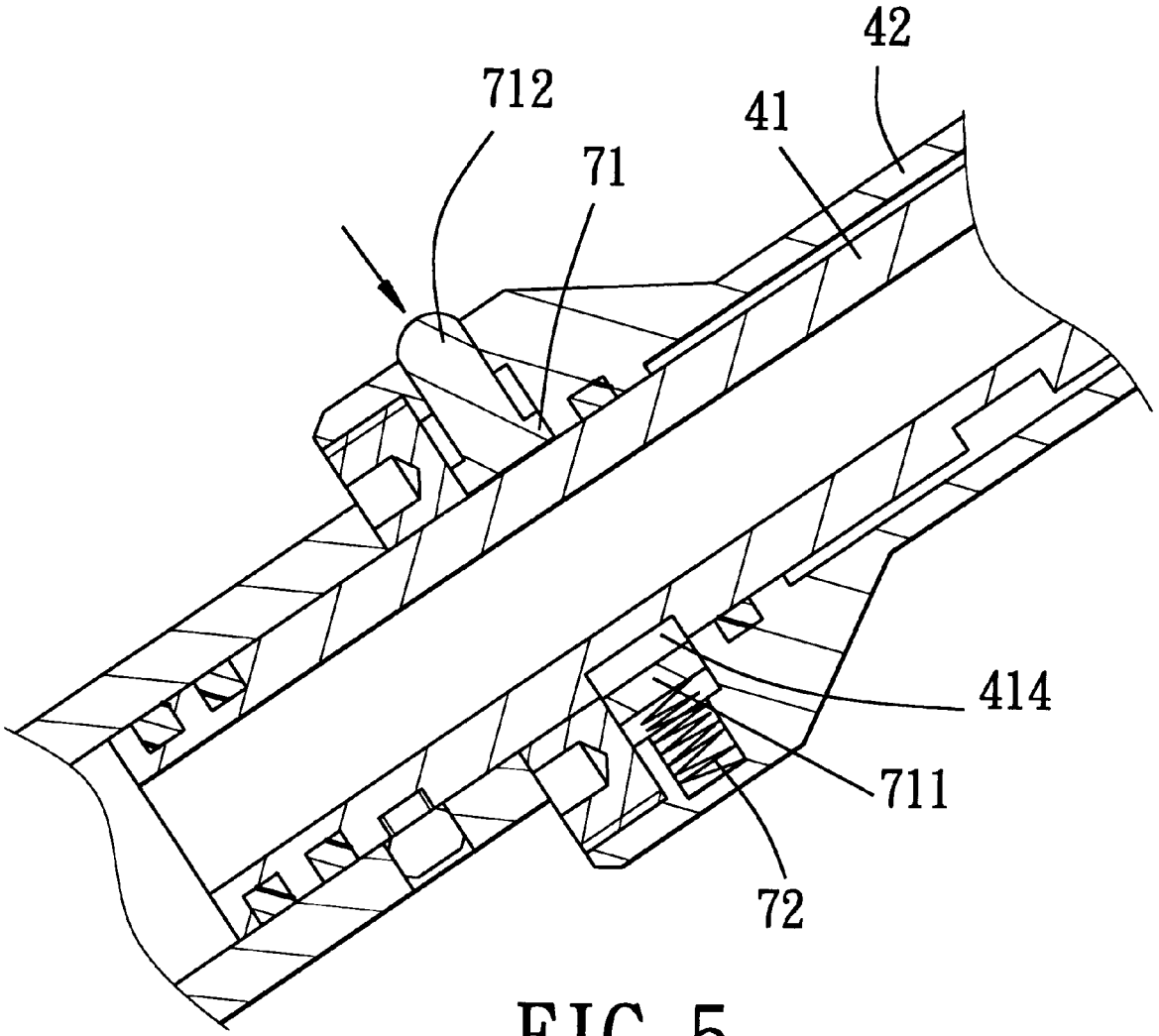
FIG. 5 is a fragmentary sectional view showing a lock member of the preferred embodiment in a retracted position.

As illustrated, the latch portion 711 is movable in the second radial direction between an arrested position, as shown in FIG. 3, where the latch portion 711 is registered with and extends into one of the retaining recesses 414 and is retained within the retaining recess 414 so as to arrest the inner peripheral wall from moving relative to the outer circumferential wall 4171 of the inner tube 41, and a retracted position, as shown in FIG. 5, where, by pressing the stem portion 712 inwardly against the biasing force of the biasing member 72, the latch portion 711 is moved to be relieved from the retaining recess 414 so as to permit sliding movement of the first segment 4271 relative to the outer circumferential wall 4171 of the inner tube 41 and increase the distance between the spout head 43 and the outlet tube 21, as shown in FIG. 4. At this time, the latch portion 711 can be registered with and extend into another retaining recess 414 so as to be disposed in the arrested position.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A spout assembly adapted to be in fluid communication with a faucet body of a faucet which includes a valve to control the flow of water stream into the faucet body, said spout assembly comprising:

an inner tube including a first tubular end portion adapted to be in fluid communication and in water tight connection with the faucet body, a second tubular end portion opposite to said first tubular end portion in a first axial direction, and an intermediate tubular portion interposed between said first and second tubular end portions, and having an outer circumferential wall, wherein said outer circumferential wall has a plurality of retaining recesses disposed therein, and spaced apart from and aligned with one another in the first axial direction;

an outer tube telescopically fitted on said inner tube, and including a proximate tubular end slidably fitted on said outer circumferential wall and proximate to said first tubular end portion, a distal tubular end opposite to said proximate tubular end and extending beyond said second tubular end portion, and a middle tubular portion interposed between said proximate and distal tubular ends, and having an inner peripheral wall that faces said outer circumferential wall and that includes first and second segments respectively proximate and distal to said proximate tubular end;

a lock member including a latch portion disposed in said inner peripheral wall proximate to said proximate tubular end, a stem portion disposed diametrically opposite to said latch portion and radially and outwardly of said middle tubular portion so as to permit an external operation of said stem portion, and a connecting portion connecting said latch portion to said stem portion so as to permit said stem portion to move said latch portion radially between an arrested position, where said latch portion is registered with and extends into one of said retaining recesses and is retained within said one of said retaining recesses so as to arrest said inner peripheral wall from moving relative to said outer circumferential wall, and a retracted position, where said latch portion is radially moved to be relieved from said one of said retaining recesses and to permit sliding movement of said first segment relative to said outer circumferential wall; and a biasing member disposed to bias said latch portion to extend into said one of said retaining recesses in the arrested position.

2. The spout assembly as claimed in claim 1, wherein said connecting portion is arcuate in shape and is disposed around and is spaced apart from said intermediate tubular portion.

3. The spout assembly as claimed in claim 2, wherein said biasing member is a compression spring disposed between said latch portion and said first segment in a second axial direction that is radial to the first axial direction such that said latch portion is movable to the retracted position by the external operation of said stem portion against a biasing force of said biasing member.

4. The spout assembly as claimed in claim 1, wherein said second segment of said middle tubular portion is radially spaced from said outer circumferential wall to define an annular accommodating area therebetween.

5. The spout assembly as claimed in claim 4, wherein said middle tubular portion has an annular abutment shoulder disposed radially at a juncture of said first and second segments, said outer circumferential wall having an annular barrier portion disposed proximate to said second tubular end portion and cooperating with said abutment shoulder to confine said annular accommodating area in the first axial direction such that said abutment shoulder will be blocked by said barrier portion from further movement during the sliding movement of said first segment relative to said outer circumferential wall so as to prevent said first segment from slipping over and falling out of said second tubular end portion.

6. The spout assembly as claimed in claim 1, further comprising a friction member disposed in said first segment between said lock member and said second segment and in slidable contact with said outer circumferential wall so as to retard the sliding movement of said first segment relative to said outer circumferential wall.

7. The spout assembly as claimed in claim 1, further comprising a spout head mounted on said distal tubular end for changing directions of the water stream.

8. The spout assembly as claimed in claim 1, further comprising a scald-preventing member disposed to wrap around said middle tubular portion.

* * * * *